US005806634A

United States Patent [19]

Engle

[11] Patent Number: 5,806,634

[45] Date of Patent: Sep. 15, 1998

[54] OFFSET ARRANGEMENT FOR BRAKE SYSTEM PROPORTIONALIZATION LEVER

[75] Inventor: Thomas H. Engle, Clayton, N.Y.

[73] Assignee: Westinghouse Air Brake Company, Wilmerding, Pa.

[21] Appl. No.: 748,241

[22] Filed: Nov. 12, 1996

[51] Int. Cl.[6] ..... B61H 13/00

[52] U.S. Cl. ..... 188/52; 188/220.1

[58] Field of Search ..... 188/52, 53, 70 R, 188/219.1, 222.1, 222.6, 223.1, 225.6, 226.1

[56] References Cited

U.S. PATENT DOCUMENTS

| | | | |
|---|---|---|---|
| 2,226,507 | 12/1940 | Baselt | 188/52 |
| 3,177,984 | 4/1965 | Taylor | 188/52 |
| 3,335,825 | 8/1967 | Mersereau et al. | 188/52 |
| 4,413,569 | 11/1983 | Mulcahy | 188/52 |
| 5,000,298 | 3/1991 | Jackson et al. | 188/52 |
| 5,495,921 | 3/1996 | Samulak et al. | 188/52 |

*Primary Examiner*—Chris Schwartz
*Attorney, Agent, or Firm*—James Ray &Associates

[57] ABSTRACT

This invention provides an apparatus for applying proportional forces to at least two brake pads for application to rotating machinery. A member moveable parallel to a first axis has a first pivot connection having a second axis about perpendicular to the first axis, a second pivot connection having a third axis about perpendicular to the first axis and parallel to the second axis, and a third pivot connection having a fourth axis about perpendicular to the first, second, and third axes. A proportionalization lever has a length about parallel to the second and third axes, which is pivotally connected to the third pivot connection. It has a first end portion and a second end portion, with its pivot connection disposed intermediate its first end portion and its second end portion. A first brake pad positioning means for a first brake pad is pivotally connected to the first pivot connection, and a second brake pad positioning means for a second brake pad is pivotally connected to the second pivot connection. A first force communication means communicates force from the first proportionalization lever end portion to the first brake pad positioning means to apply force to the first brake pad, and a second force communication means communicates force from the second proportionalization lever end portion to the second brake pad positioning means, to apply force to the second brake pad. Force applied to the second brake pad is proportional to the force applied to the first brake pad.

20 Claims, 6 Drawing Sheets

OFFSET ARRANGEMENT FOR BRAKE SYSTEM PROPORTIONALIZATION LEVER

CROSS REFERENCE TO RELATED APPLICATIONS

The invention taught in this patent application is closely related to the inventions taught in the following co-pending patent applications: Tread-Disc Assist Dual Truck Mounted Brake Assembly, 08/749,199 Cooling Spoke Arrangement For A Brake Disc 08/745,429, Wedge-Shaped Disc Brake Shoe 08/748,200. The referenced patent applications are being filed concurrently with the present application, and are assigned to the assignee of the present invention. The teachings of the referenced patent applications are incorporated into the present application by reference thereto.

FIELD OF THE INVENTION

The present invention relates, in general, to a brake system for retardation of rotating machinery, and, more particularly, the invention relates to a tread-disc assist brake system for railway vehicles.

BACKGROUND OF THE INVENTION

The art of railway braking systems includes two methods of retarding a railway vehicle. One method is dynamic braking, in which the propulsion motors of a diesel-electric locomotive are used to generate electricity which is then dissipated through resistors.

Another method is friction braking in which brake shoes are pressed against the treads of the wheels of the railway vehicle, to provide a friction force which retards the wheels, and hence retards the railway vehicle.

Friction braking may also be provided by attaching a disc to a wheel or to an axle of the vehicle, and pressing brake shoes against the disc, thereby providing a friction force which retards the disc and hence retards the wheels.

For friction braking in which brake shoes are applied to the wheels, heat is absorbed by the thermal mass of the wheels, and then dissipated to the environment by conduction, convection, and radiation from the wheels.

For friction braking in which brake shoes are applied to discs, heat is absorbed by the thermal mass of the brake discs, and then dissipated to the environment by conduction, convection, and radiation from the discs.

In both cases, the amount of energy which can be absorbed is limited by the temperatures generated, since high temperatures may damage the brake shoes, or cause thermal stresses which cause warping or cracking of the wheels or brake discs.

In some systems, the two methods are combined so that some of the heat is absorbed by the wheels, and some is absorbed by the discs. By combining the two methods, more heat can be absorbed than can be absorbed by either method separately.

Systems combining the two methods generally employ an arrangement of brakebeams and levers, in which a single actuator, such as a brake cylinder, applies equal or proportional forces to a number of brake shoes, some of which may be applied to wheels, and some of which may be applied to discs which rotate with the wheels.

Such systems may connect a single brake cylinder to brake shoes applied to both wheels on an axle, or to all the wheels on two or more axles. The brakebeam arrangements which are typically used apply equal forces to the brake shoes on all the wheels on a truck of the railway vehicle.

Likewise, if each wheel has a disc associated with it, a brakebeam arrangement may communicate an equal force to each wheel & disc set, and then a lever arrangement, repeated for each wheel and disc set, may be provided to apportion the brake shoe application forces between the wheel tread and the disc. It is usually desirable for the wheel and disc application forces to be proportional to each other. For example, the forces may be equalized.

In some of these systems, brake shoes are applied to the rims of the brake discs. In others, brake shoes are applied to the faces of the discs. Application to the rim has an advantage over application to the face because the radius at which the friction torque is generated is greater when force is applied to the rim than when force is applied to the face. Put another way, the retarding torque exerted on the brake disc is greater when the shoe is applied with a given force to the rim than when the shoe is applied with the same force to the disc face.

For a railway vehicle, it is particularly important to apply the brake shoe at as great a radius as possible because the radius of the disc is limited by the required track clearance. In the United States, this is 2.75 inches, so the greatest possible radius of the brake disc must be 2.75 inches less than the radius of the wheel tread. Further, it is the radius of the fully worn wheel rather than a new one, which must be considered.

The environment in which the brakebeams, levers, brake shoes, etc are used is quite confining spatially. In particular, the ends of the brakebeams have support plates which rest on wear plates that are part of the side frames of the truck, so the arrangement of levers, etc, must be mounted inboard of the ends of the brakebeams. An example of such a configuration is given in U.S. Pat. No. 4,008,789. This configuration, however, unfortunately provides a brake shoe applied to the face of a brake disc, rather than to the rim of a brake disc.

U.S. Pat. No. 2,422,004 shows a configuration in which a brake disc is located some distance inboard from the wheel, leaving room therebetween for a lever arrangement to apply equal forces to brake shoes applied to the rim of the disc and the tread of the wheel. This design has the difficulty that the disc is located so far inboard from the wheel, to provide space for an equalizer lever, that it would be difficult to attach it to the wheel, so the disc would probably need to be attached to the axle, a more difficult procedure, and one requiring a special axle with more machining than required by the Standard.

U.S. Pat. Nos. 4,004,656 and 4,014,409 show configurations in which the disc is bolted directly to the wheel, brake shoes applied to the tread of the wheel and the rim of the disc, and an equalization or proportionalization lever having ends located adjacent the brake shoes. In this design, the lever must be quite short because of the close proximity of the disc and the wheel. In addition, the brake shoes are aligned by having them pass through ports in the brakebeam, and hence have frictional contact with the brakebeam which may affect both brake release, and the efficiency of braking force transmission to the brake pads.

U.S. Pat. No. 2,924,152 provides for a disc bolted directly to the wheel, and provides equal forces to the tread and disc brake shoe linkages by having a brake cylinder associated with each wheel and disc set. This design has the disadvantage that every wheel of the railway vehicle must have its own brake cylinder, along with attendant piping.

SUMMARY OF THE INVENTION

The present invention provides an apparatus for applying proportional forces to two or more brake pads for application to rotating machinery to retard the rotating machinery. For example only, the invention may be used in a braking system for railway vehicles. A member moveable parallel to a first axis, such as, for example only, a brakebeam, has a first pivot connection having a second axis about perpendicular to the first axis, a second pivot connection having a third axis about perpendicular to the first axis and parallel to the second axis, and a third pivot connection having a fourth axis about perpendicular to the first, second, and third axes. It has a proportionalization lever having a length about parallel to the second and third axes, the lever being pivotally connected to the third pivot connection. It has a first end portion and a second end portion, with its pivot connection disposed intermediate its first end portion and its second end portion. A first brake pad positioning means for a first brake pad is pivotally connected to the first pivot connection, and a second brake pad positioning means for a second brake pad is pivotally connected to the second pivot connection. A first force communication means communicates force from the first proportionalization lever end portion to the first brake pad positioning means to apply force to the first brake pad, and a second force communication means communicates force from the second proportionalization lever end portion to the second brake pad positioning means, to apply force to the second brake pad. Force applied to the second brake pad is proportional to the force applied to the first brake pad.

OBJECTS OF THE INVENTION

It is therefore a principal object of the present invention to provide an arrangement for use on a brakebeam of a railway vehicle to apply proportional forces to two or more brake pads, one pad applied to a tread of a wheel of the railway vehicle and another brake pad applied to a brake disc mounted on the wheel or axle of the railway vehicle.

It is another object of the present invention to provide an arrangement in which a brake shoe applied to a brake disc is applied to a rim of the disc to maximize the braking torque applied to the disc.

It is a further object of the present invention to provide an arrangement in which a brake disc is attached to a wheel of the railway vehicle, rather than to an axle to both facilitate mounting, and reduce cost and weight.

It is yet a further object of the present invention to provide an arrangement which may be used in the confining spaces available on a truck of a railway vehicle.

It is also an object of the present invention to provide an arrangement spacially offset relative to the wheel and the brake disc of the railway vehicle to avoid interference with truck side frames or other structures of the railway vehicle.

It is another object of the present invention to provide an arrangement in which a lever used to proportionalize force between tread and disc brakepads may have a length exceeding a separation, measured parallel to the axle, between the friction surface on the rim of the disc, and the friction surface on the tread of the wheel.

In addition to the various objects and advantages of the present invention which have been generally described above, there will be various other objects and advantages of the invention that will become more readily apparent to those persons who are skilled in the relevant art from the following more detailed description of such invention, particularly, when such detailed description is taken in conjunction with the attached drawing figures and with the appended claims.

Figure 1:
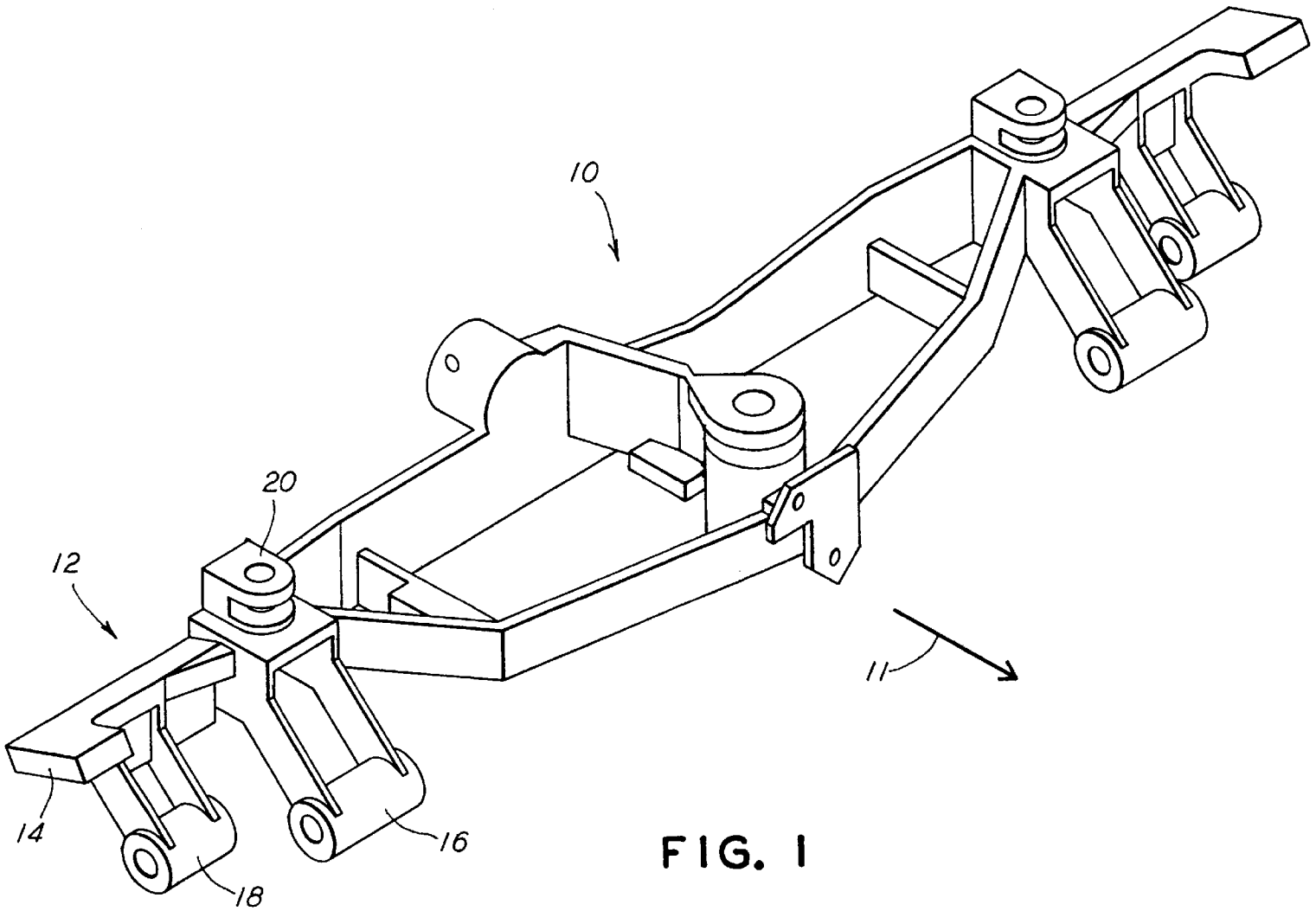
FIG. 1 is a perspective of a brakebeam for a railway vehicle braking system, the brakebeam having pivot connections according to the present invention.

BRIEF DESCRIPTION OF THE PRESENTLY MOST PREFERRED AND VARIOUS ALTERNATIVE EMBODIMENTS OF THE INVENTION

Prior to proceeding to the much more detailed description of the present invention, it should be noted that identical components which have identical functions have been identified with identical reference numerals throughout the several views illustrated in the drawing figures, for the sake of clarity and understanding of the invention.

FIG. 1 shows a perspective drawing of a brakebeam, generally denoted 10, for a railway vehicle braking system, according to a presently most preferred embodiment of the present invention. Brakebeam 10 may be moved parallel to axis 11, for application of the brakes.

Figures 2A, 2B:
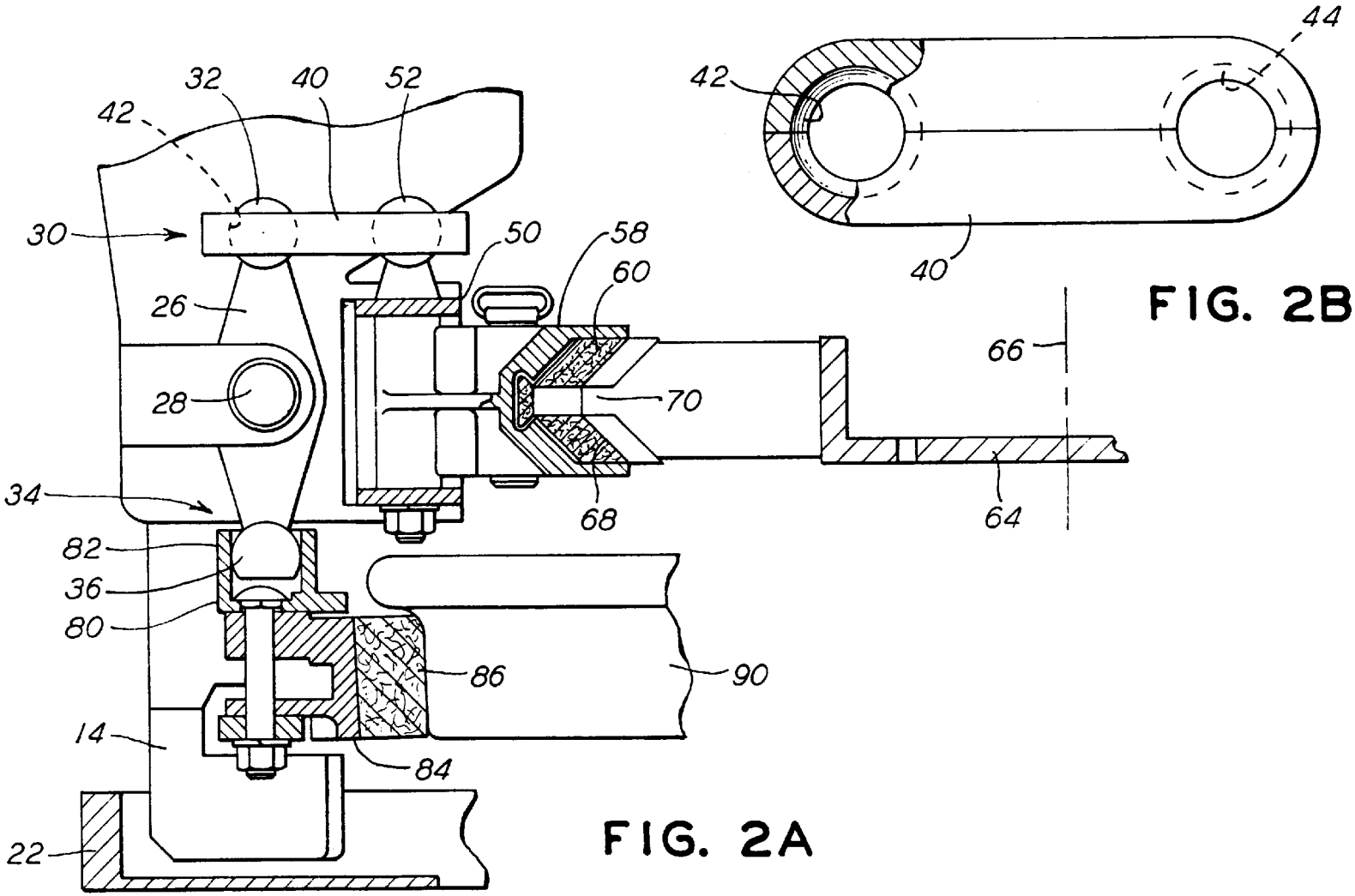
FIG. 2A is a plan view of an end portion of a brakebeam, showing brakehangers for tread and disc brake shoes in greater detail.
FIG. 2B shows a link used for conveying a proportionalized force to a hanger for the disc brake.

Brakebeam 10 has an end portion 12, and a support plate 14 for mounting the brakebeam on a truck side frame of a railway vehicle (not shown). End portion 12 has a first pivot connection 16, second pivot connection 18 and third pivot connection 20. Pivot connections 16 and 18 are for pivots having axes approximately parallel to brakebeam 10. Third pivot connection 20 is for a pivot having an axis approximately perpendicular to brakebeam 10. FIG. 2A shows a detail of end portion 12 of brakebeam 10, and includes attached brake heads and pads. A proportionalization lever 26 is pivotally connected at proportionalization lever pivot connection 28 to third pivot connection 20 of first end portion 12 of brakebeam 10. (Shown in FIG. 1.)

Proportionalization lever 26 has first force delivery means 32 at its first end portion 34, and a second force delivery means 36 at its second end portion 34.

FIG. 2B shows link 40 having force receiving means 42 connected to first force delivery means 32 of proportionalization lever 26.

Figure 2C:
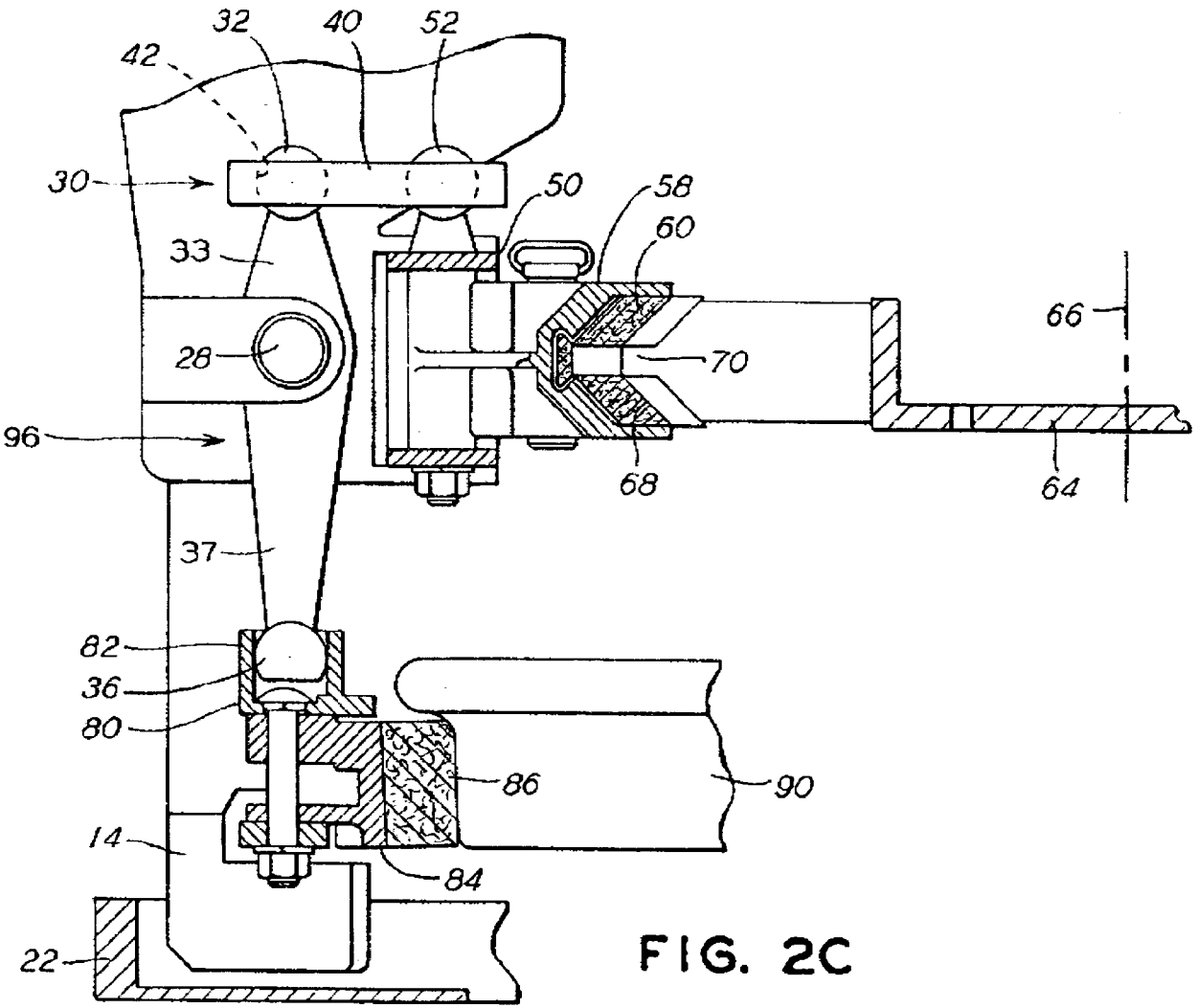
FIG. 2C shows a plan view of an end portion of a brakebeam and a proportionalization lever having a first lever arm between the proportionalization lever pivot connection and the first force delivery means not equal to a second lever arm between the proportionalization lever pivot connection and the second force delivery means.

FIG. 2C shows an alternative proportionalization lever 96 in which a first lever arm 33 between the proportionalization lever pivot connection 28 and the first force delivery means 32 and a second lever arm between the proportionalization lever pivot connection 28 and the second force delivery means 36 are unequal.

Figure 3C:
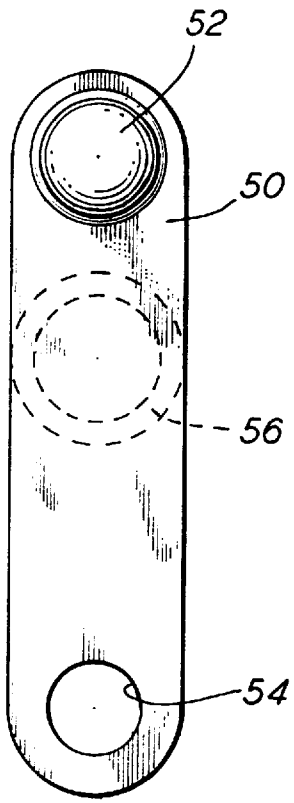
FIG. 3C is a view of the brake hanger for the disc brake shoe, which is taken looking parallel to the long dimension of the brakebeam.
Figure 3B:
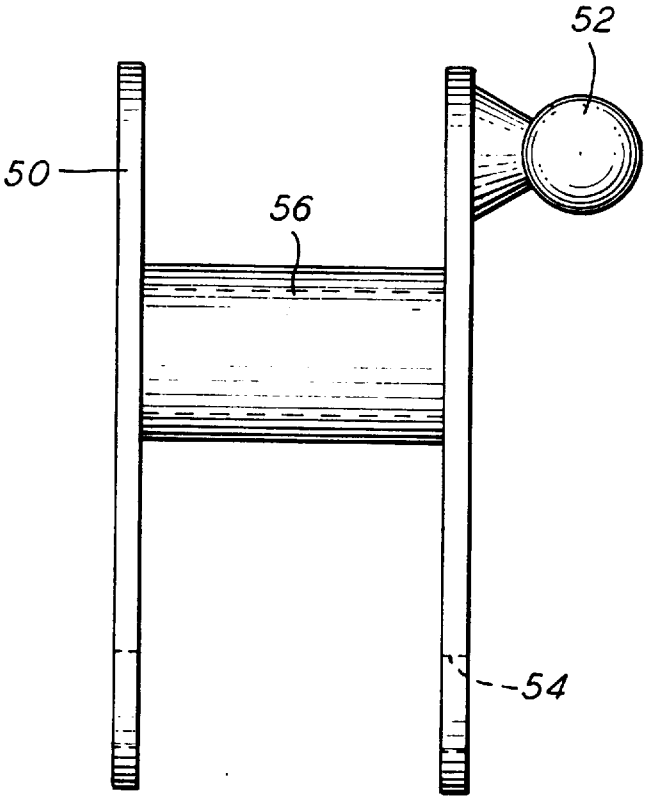
FIG. 3B shows a view of the brake hanger for the disc brake shoe, which is taken looking transversely to the long dimension of the brakebeam.
Figure 3A:
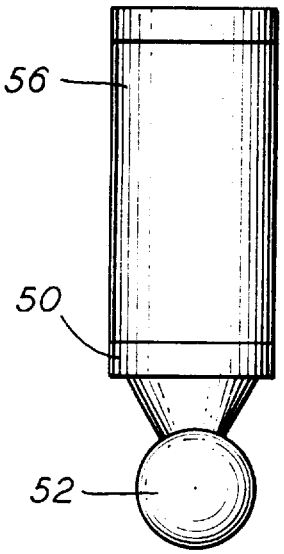
FIG. 3A shows a top view of a brake hanger for a disc brake shoe.

FIG. 3A shows a top view of disc brake hanger 50 to which link 40 is connected.

In the embodiment shown, first force delivery means 32 is a protuberance having a part spherical surface formed on first end portion 30 of proportionalization lever 26, and force receiving means 42 is a hole or socket formed in link 40.

Link 40 has force delivery means 44 connected to disc brake hanger 50 at disc brake hanger force receiving means 52. In the embodiment shown, disc brake hanger force receiving means 52 is formed as a protuberance having a part spherical surface, and link force delivery means 44 is formed as a hole or socket into which disc brake hanger force receiving means 52 fits.

FIG. 3B shows a view of disc brake hanger 50 viewed perpendicular to brakebeam 10 when they are assembled, and FIG. 3C is a view of disc brake hanger 50 viewed parallel to brakebeam 10 when they are assembled.

Disc brake hanger 50 is pivotally connected to first pivot connection 16 of first end portion 12 of brakebeam 10 at disc brake hanger first pivot connection 54. Disc brake hanger 50 has disc brake hanger second pivot connection 56.

Disc brake shoe 58 is connected to disc brake hanger 50 at disc brake hanger second pivot connection 56. Disc brake shoe pad 60 is mounted on disc brake shoe 58.

FIG. 2A shows a brake disc 64 having axis 66. Brake shoe pad 60 is pressed against brake disc 64 to retard brake disc 64. Brake shoe pad 60 is pressed against brake disc 64 at disc friction surfaces 68. An air passage 70 is provided in brake disc 64 for cooling brake disc 64.

Figure 4D:
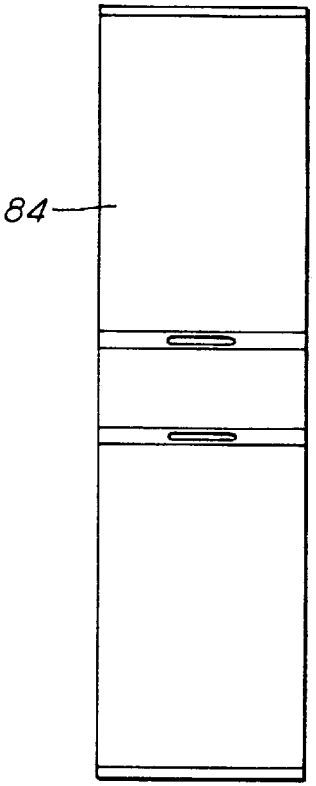
FIG. 4D shows a front view of the tread brake shoe.
Figure 4C:
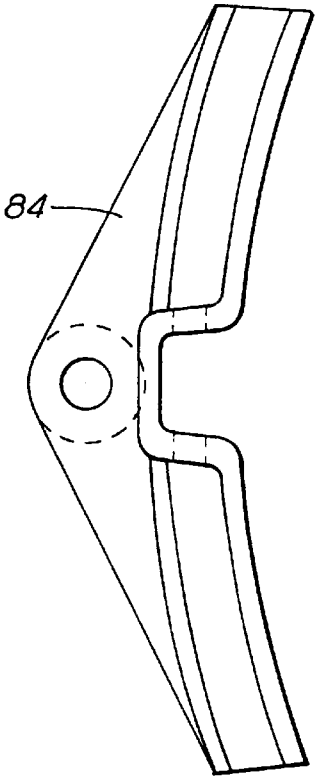
FIG. 4C shows a side view of the tread brake shoe.
Figure 4B:
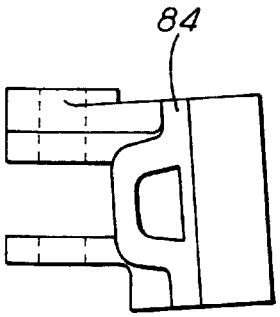
FIG. 4B is a top view of the tread brake shoe.
Figure 4A:
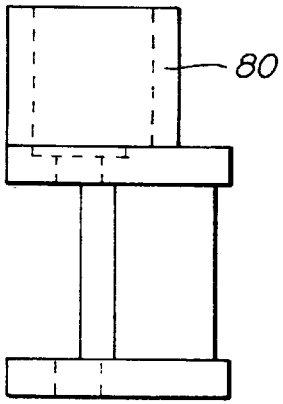
FIG. 4A shows a top view of the tread brake hanger.

FIG. 2 and also FIG. 4A show tread brake hanger 80, which is pivotally connected to brakebeam 10 at end portion second pivot connection 18. Tread brake hanger 80 has force receiving means 82. In the embodiment shown, force receiving means 82 is a socket for enclosing second force delivery means 36 of proportionalization lever 26. Tread brake shoe 84 is attached to tread brake hanger 80. Tread brake shoe 84 is applied to railway vehicle wheel 90 to retard wheel 90. Wheel 90 has a common centerline with centerline 66 of disc 64.

Figure 5:
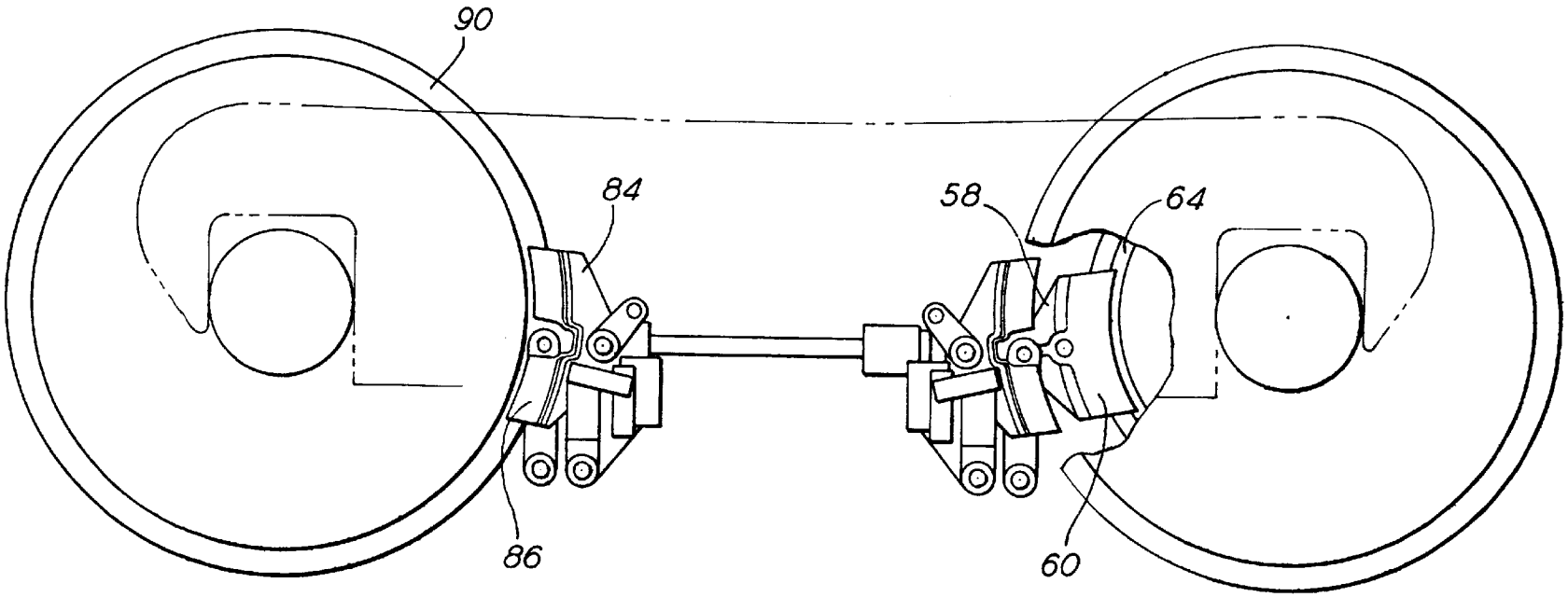
FIG. 5 shows an axial view of the braking system of the present invention applied to two axles of a railway vehicle.

FIG. 5 shows the system viewed parallel to axis 66 of disc 64 and wheel 90. This figure shows disc brake shoe 58 and disc brake pad 86, tread brake shoe 84, and tread brake pad 86 and wheel 90.

The flow of forces in this system is as follows: Brakebeam 10 moves parallel to axis 11, in the direction indicated by the arrowhead on axis 11. In this manner, pivot connections 16, 18, and 20, which provide for positioning brakeshoes 58 and 84, are moved toward wheel 90 and disc 64. This brings disc brake pad 60 into contact with disc 64, and tread brake pad 86 into contact with the tread of wheel 90. Force directed parallel to axis 11 is applied through the third pivot connection 20 of brakebeam end portion 12 to the proportionalization lever pivot connection 20, and hence to the proportionalization lever 26. Force applied to the proportionalization lever pivot connection 28 flows out of the proportionalization lever 26 through the first force delivery means 96 and the second force delivery means 100. Balance of moments in the proportionalization lever, taken about proportionalization lever pivot connection 28, causes the forces delivered at the first and second force delivery means, 96 and 100 to be proportional to each other, and inversely proportional to the ratio of the moment arms between these and proportionalization lever pivot connection 28. In the example shown in FIG. 2A, these moment arms are equal, so the forces are equal. In the example shown in FIG. 2C, these moment arms are unequal, so the forces are unequal. The forces are, however, proportional to each other.

A first force delivered by first force delivery means 96 is received by link force receiving means 42, conveyed by link 40 to link force delivery means 44, and received by disc brake hanger force receiving means 52.

A second force delivered by second force delivery means 36 is received by the force receiving means 82 of the tread brake hanger. Hence, the force applied to the disc brake hanger 50 is proportional to the force applied to the tread brake hanger 80.

Examination of the drawings will show that this purpose is achieved in the present invention with an arrangement which is offset along the major dimension of brakebeam 10. By means of this offset, the proportionalization lever 26 is offset in the inboard direction of the brakebeam 10 relative to the brakeshoes 58 and 84. This enables disc 64 to be mounted close to wheel 90 (for example, by bolting to it), and it avoids interferences at the end of brakebeam 10 where brakebeam 10 is supported by its support plate 14 on a side frame (not shown) of the railway vehicle.

Now, discussing the apparatus more broadly, there is disclosed an apparatus for applying proportional forces to at least two brake pads 60 and 86, the brake pads for forcible application to rotating machinery to retard the rotating machinery. The apparatus has a displaceable member, such as brakebeam 10 which may be moved parallel to a first axis, the displaceable member having a first pivot connection 16 which has a second axis about perpendicular to the first axis. The displaceable member 10 also has a second pivot connection 18 having a third axis, the third axis about parallel to the second axis, and about perpendicular to the first axis. The displaceable member also has a third pivot connection, the third pivot connection having a fourth axis, the fourth axis being about perpendicular to the first axis, and about perpendicular to the second axis, and about perpendicular to the third axis.

The apparatus has a proportionalization lever 26 or 96 which has a major dimension, the major dimension being about parallel to the second axis and about parallel to the third axis, the proportionalization lever having a pivot connection 28 pivotally connected to the third pivot connection 20 of the displaceable member 10 for pivotal rotation about the fourth axis. The proportionalization lever 26 or 96 has a first end portion 30 and a second end portion 34 the proportionalization lever pivot connection 28 being disposed intermediate the first end portion 30 and the second end portion 34 of the proportionalization lever.

The apparatus has a first brake pad positioning means such as disk brake hanger pivotally connected to the first pivot connection 16 of the displaceable member 10, and a first brake shoe 58 with first brake shoe pad 60 attached to it. The first brake pad is for application to the rotating machinery for retardation of the rotating machinery.

The apparatus has a second brake pad positioning means such as tread brake hanger 80 pivotally connected to the second pivot connection 18 of the displaceable member 10, and a second brake shoe 84 with second brake shoe pad 86 attached to it. The second brake pad, also, is for application to the rotating machinery for retardation of the rotating machinery.

The apparatus has a first force communication means such as ball 32 for communicating a first force from the first end portion 30 of the proportionalization lever 26 or 96 to the first brake pad positioning means 50, so that the first brake pad positioning means applies a third force to the first brake pad, 60. Since the first brake pad positioning means is pivoted about the first pivot connection 16, the third force is proportional to the first force.

The apparatus has a second force communication means such as ball 56 for communicating a second force from the second end portion of the proportionalization lever 26 or 96 to the second brake pad positioning means 80, so that the second brake pad positioning means 80 applies a fourth force to the second brake pad 86. Since the second brake pad positioning means 80 is pivoted about second pivot connection 18, the fourth force is proportional to the second force.

The proportionalization lever 26 or 96 causes the second force to be proportional to the first force so that the third force applied to the first brake pad 60 is proportional to the fourth force applied to the second brake pad 86.

The first force communication means 32 may communicate the first force while allowing at least two axes of relative rotational freedom between the first end portion 30 of the proportionalization lever 26 or 96 and the first brake pad positioning means 50, and the second force communication means 36 may likewise apply the second force while allowing at least two axes of relative rotational freedom between the second end portion 34 of the proportionalization lever 26 or 96 and the second brake pad positioning means 80.

Either or both of the force communication means 32 or 36 may include a protuberance and an enclosure for the protuberance, such as a ball and socket joint 32 and 42 or 36 and 82.

The first brake pad positioning means may include a first brake hanger "50" pivotally connected to the first pivot connection 16 of the displaceable member, a first brake shoe 58 pivotally connected to the first brake hanger, and the first brake pad 60 attached to the first brake shoe.

The first force communication means may include a link 40 connected to the first end portion 30 of the proportionalization lever and to the first brake pad positioning means 50.

A first lever arm between the first end portion 30 of the proportionalization lever and the proportionalization lever pivot connection 28 may be about equal to a second lever arm between the second end portion 34 of the proportionalization lever and the proportionalization lever pivot connection 28, so that the first force is about equal to the second force.

The first lever arm 33 between the first end portion of the proportionalization lever and the proportionalization lever pivot connection may be unequal to the second lever arm 37 between the second portion of the proportionalization lever and the proportionalization lever pivot connection, so that the first force is about equal to the second force multiplied by the second lever arm divided by the first lever arm.

The first brake pad may have a positional coordinate parallel to the second axis about equal to a like positional coordinate of the first end portion 30 of the proportionalization lever 26 or 96, or the first brake pad may be offset relative to the first end portion of the proportionalization lever along a positional coordinate parallel to the second axis.

The invention also provides an apparatus for applying proportional forces to two brake pad positioning means 50 and 80 mounted on one end of a brakebeam 10 in a railway vehicle braking system. The brakebeam 10 is mounted on a truck of the railway vehicle so that it can be moved parallel to a first axis, which is parallel to the lengthwise dimension of the truck, and is directed toward an adjacent axle of the railway vehicle. One of the brake pad positioning means 50 being for application of a brake pad to a rim 68 of a brake disc 64 and a second one of the brake pad positioning means 80 for application of a brake pad to a tread of a wheel 90 of the railway vehicle. The brake disc being attached to at least one of the wheel and an axle on which the wheel is mounted, in a location adjacent the wheel.

The apparatus has three pivot connections 16, 18, and 20, each of the three pivot connections either formed as a portion of or attached to the brakebeam at an end portion of the brakebeam. The first one of these three pivot connections 16 has a second axis about parallel to the major dimension of the brakebeam, a second one of the three pivot connections 18 has a third axis about parallel to the major dimension of the brakebeam, and the third one of the three pivot connections 20 having a fourth axis about perpendicular to the major dimension of the brakebeam.

The apparatus has a proportionalization lever 26 or 96 having a major dimension, the major dimension of the proportionalization lever being about parallel to the major dimension of the brakebeam. The proportionalization lever has a pivot connection 28 pivotally connected to the third pivot connection 20 for pivotal rotation about the fourth axis.

The proportionalization lever has a first end portion 30 and a second end portion 34, the proportionalization lever pivot connection being located intermediate the first end portion and the second end portion of the proportionalization lever.

The apparatus has a first brake pad positioning means 50 pivotally connected to the first pivot connection of the brakebeam, and a first brake pad 60 attached to the first brake pad positioning means, the first brake pad for application to the brake disc 64 for retardation of the brake disc, and hence for retardation of the wheel 90.

The apparatus also has a second brake pad positioning means 80 pivotally connected to the second pivot connection of the brakebeam, and a second brake pad attached to the second brake pad 86 positioning means, the second brake pad for application to the tread of the wheel for retardation of the wheel.

There is a first force communication means such as first force delivery means 32 of proportionalization lever 26 or 96, link force receiving means 42, link 40, and link force delivery means 44 and disk brake hanger force receiving means 52 for communicating a first force from the first end portion 30 of the proportionalization lever 26 or 96 to the first brake pad positioning means, the first brake pad positioning means applying a third force to the first brake pad. Since the first brake pad positioning means 50 is pivoted about the first pivot connection 16, the third force is proportional to the first force.

There is also a second force communication means such as second force delivery means 36 of proportionalization lever 26 or 96, and force receiving means 82 of tread brake hanger 82 for communicating a second force from the second end portion 34 of the proportionalization lever 26 or 96 to the second brake pad positioning means, the second brake pad positioning means applying a fourth force to the second brake pad. Since the second brake pad positioning means 80 is pivoted about the second pivot connection 18, the fourth force is proportional to the second force.

The proportionalization 26 or 96 causes the second force to be proportional to the first force so that the third force applied to the first brake pad is proportional to the fourth force applied to the second brake pad.

The first force communication means may communicate the first force while allowing at least two axes of relative rotational freedom between the first end portion 30 of the proportionalization lever and the first brake pad positioning means 50.

Likewise, the second force communication means may communicate the second force while allowing at least two axes of relative rotational freedom between the second end portion 34 of the proportionalization lever and the second brake pad positioning means 80.

Either or both the first force communication means and the second force communication means may include a protuberance such as 32 and an enclosure such as 42 for the protuberance. These may constitute a ball and socket joint.

The first brake pad positioning means may include a first brake hanger 50 pivotally connected to the first pivot connection 16 of the brakebeam, and a first brake shoe 58 pivotally connected to the first brake hanger, the first brake pad 60 being attached to the first brake shoe.

The first force communication means may include a link 40 connected to the first end portion of the proportionalization lever and to the first brake pad positioning means.

The first lever arm between the first end portion of the proportionalization lever and the proportionalization lever pivot connection may be about equal to a second lever arm between the second portion of the proportionalization lever and the proportionalization lever pivot connection, so that the first force is about equal to the second force.

Conversely, the first lever arm 33 between the first end portion of the proportionalization lever and the proportionalization lever pivot connection may be unequal to the second lever arm 37 between the second portion of the proportionalization lever and the proportionalization lever pivot connection, so that the first force is about equal to the second force multiplied by the second lever arm divided by the first lever arm.

The first brake pad may be offset relative to the first end portion of the proportionalization lever along a positional coordinate parallel to the second axis.

While a presently preferred and various additional alternative embodiments of the instant invention have been described in detail above in accordance the patent statutes, it should be recognized that various other modifications and adaptations of the invention may be made by those persons who are skilled in the relevant art without departing from either the spirit or the scope of the appended claims.

In the claims which follow, the word "such" is used to refer to the environment of the invention, and the word "said" is reserved for portions of the invention itself.

I claim:

1. An apparatus for applying proportional forces to at least two brake pads, said at least two brake pads for forcible application to rotating machinery to retard such rotating machinery, said apparatus comprising:

(a) a displaceable member which may be moved parallel to a first axis, said displaceable member having a first pivot connection, said first pivot connection having a second axis, said second axis about perpendicular to said first axis, said displaceable member further having a second pivot connection, said second pivot connection having a third axis, said third axis about parallel to said second axis, and about perpendicular to said first axis, said displaceable member also having a third pivot connection, said third pivot connection having a fourth axis, said fourth axis about perpendicular to said first axis, and about perpendicular to said second axis, and about perpendicular to said third axis;

(b) a proportionalization lever having a major dimension, said major dimension of said proportionalization lever about parallel to said second axis and about parallel to said third axis, said proportionalization lever having a pivot connection pivotally connected to said third pivot connection of said displaceable member for pivotal rotation about said fourth axis, said proportionalization lever having a first end portion and a second end portion, said proportionalization lever pivot connection disposed intermediate said first end portion and said second end portion of said proportionalization lever;

(c) a first brake pad positioning means pivotally connected to said first pivot connection of said displaceable member;

(d) a first brake pad attached to said first brake pad positioning means, said first brake pad for application to such rotating machinery for retardation of such rotating machinery;

(e) a second brake pad positioning means pivotally connected to said second pivot connection of said displaceable member;

(f) a second brake pad attached to said second brake pad positioning means, said second brake pad for application to such rotating machinery for retardation of such rotating machinery;

(g) a first force communication means for communicating a first force from said first end portion of said proportionalization lever to said first brake pad positioning means, said first brake pad positioning means applying a third force to said first brake pad, said third force being proportional to said first force;

(h) a second force communication means for communicating a second force from said second end portion of said proportionalization lever to said second brake pad positioning means, said second brake pad positioning means applying a fourth force to said second brake pad, said fourth force being proportional to said second force;

said proportionalization lever causing said second force to be proportional to said first force so that said third force applied to said first brake pad is proportional to said fourth force applied to said second brake pad.

2. An apparatus according to claim 1 wherein said first force communication means communicates said first force while allowing at least two axes of relative rotational freedom between said first end portion of said proportionalization lever and said first brake pad positioning means.

3. An apparatus according to claim 1 wherein at least one of said first force communication means and said second force communication means includes a protuberance and an enclosure for said protuberance.

4. An apparatus according to claim 3 wherein at least one of said first force communication means and said second force communication means is a ball and socket joint.

5. An apparatus according to claim 1 wherein said first brake pad positioning means includes a first brake hanger pivotally connected to said first pivot connection of said displaceable member, and a first brake shoe pivotally connected to said first brake hanger, said first brake pad attached to said first brake shoe.

6. An apparatus according to claim 1 wherein said first force communication means includes a first link, said first link connected to said first end portion of said proportionalization lever and to said first brake pad positioning means.

7. An apparatus according to claim 1 wherein a first lever arm between said first end portion of said proportionalization lever and said proportionalization lever pivot connection is about equal to a second lever arm between said second portion of said proportionalization lever and said proportionalization lever pivot connection, so that said first force is about equal to said second force.

8. An apparatus according to claim 1 wherein a first lever arm between said first end portion of said proportionalization lever and said proportionalization lever pivot connection is unequal to a second lever arm between said second portion of said proportionalization lever and said proportionalization lever pivot connection, so that said first force is about equal to said second force multiplied by said second lever arm divided by said first lever arm.

9. An apparatus according to claim 1 wherein said first brake pad has a positional coordinate parallel to said second axis about equal to a like positional coordinate of said first end portion of said proportionalization lever.

10. An apparatus according to claim 1 wherein said first brake pad is offset along a positional coordinate parallel to said second axis relative to said first end portion of said proportionalization lever.

11. An apparatus according to claim 1 wherein said first brake pad positioning means includes a first brake hanger pivotally connected to said first pivot connection of said brakebeam, and a first brake shoe pivotally connected to said first brake hanger, said first brake pad attached to said first brake shoe.

12. An apparatus according to claim 1 wherein said first force communication means includes a first link, said first link connected to said first end portion of said proportionalization lever and to said first brake pad positioning means.

13. An apparatus according to claim 1 wherein a first lever arm between said first end portion of said proportionalization lever and said proportionalization lever pivot connection is about equal to a second lever arm between said second portion of said proportionalization lever and said proportionalization lever pivot connection, so that said first force is about equal to said second force.

14. An apparatus according to claim 1 wherein a first lever arm between said first end portion of said proportionalization lever and said proportionalization lever pivot connection is unequal to a second lever arm between said second portion of said proportionalization lever and said proportionalization lever pivot connection, so that said first force is about equal to said second force multiplied by said second lever arm divided by said first lever arm.

15. An apparatus according to claim 1 wherein said first brake pad is offset along a positional coordinate parallel to said second axis relative to said first end portion of said proportionalization lever.

16. An apparatus for applying proportional brake application forces to a railroad brake disc and a tread of a wheel of a railway vehicle, such brake disc attached to at least one of such wheel and an axle on which such wheel is mounted, such brake disc mounted in a location adjacent such wheel, said apparatus comprising:

(a) a brakebeam movable along a first axis and having three pivot connections, each of said three pivot connections being at least one of formed as a portion of and attached to said brakebeam at an end of said brakebeam, a first one of said three pivot connections having a second axis about parallel to a major dimension of said brakebeam, a second one of said three pivot connections having a third axis about parallel to said major dimension of said brakebeam, and a third one of said three pivot connections having a fourth axis about perpendicular to said major dimension of said brakebeam;

(b) a proportionalization lever having a major dimension, said major dimension of said proportionalization lever about parallel to said major dimension of said brakebeam, said proportionalization lever having a pivot connection pivotally connected to said third pivot connection for pivotal rotation about said fourth axis, said proportionalization lever having a first end portion and a second end portion, said proportionalization lever pivot connection disposed intermediate said first end portion and said second end portion of said proportionalization lever;

(c) a first brake pad positioning means pivotally connected to said first pivot connection of said brakebeam;

(d) a first brake pad attached to said first brake pad positioning means, said first brake pad for application to such brake disc for retardation of such brake disc, and hence for retardation of such wheel;

(e) a second brake pad positioning means pivotally connected to said second pivot connection of said brakebeam;

(f) a second brake pad attached to said second brake pad positioning means, said second brake pad for application to such tread of such wheel for retardation of such wheel;

(g) a first force communication means for communicating a first force from said first end portion of said proportionalization lever to said first brake pad positioning means, said first brake pad positioning means applying a third force to said first brake pad, said third force proportional to said first force;

(h) a second force communication means for communicating a second force from said second end portion of said proportionalization lever to said second brake pad positioning means, said second brake pad positioning means applying a fourth force to said second brake pad, said fourth force proportional to said second force;

said proportionalization lever causing said second force to be proportional to said first force so that said third force applied to said first brake pad is proportional to said fourth force applied to said second brake pad.

17. An apparatus according to claim 16 wherein said first force communication means communicates said first force while allowing at least two axes of relative rotational freedom between said first end portion of said proportionalization lever and said first brake pad positioning means.

18. An apparatus according to claim 16 wherein said second force communication means communicates said second force while allowing at least two axes of relative rotational freedom between said second end portion of said proportionalization lever and said second brake pad positioning means.

19. An apparatus according to claim 16 wherein at least one of said first force communication means and said second force communication means includes a protuberance and an enclosure for said protuberance.

20. An apparatus according to claim 19 wherein at least one of said first force communication means and said second force communication means is a ball and socket joint.

* * * * *